US011801655B2

(12) United States Patent
Ruhland et al.

(10) Patent No.: US 11,801,655 B2
(45) Date of Patent: Oct. 31, 2023

(54) CORRUGATED BOARD SYSTEM

(71) Applicant: BHS Intralogistics GmbH, Mintraching (DE)

(72) Inventors: Martin Ruhland, Regensburg—Sallern-Gallingkofen (DE); Karl Ruhland, Pfreimd (DE)

(73) Assignee: BHS Intralogistics GmbH, Neutraubling (DE)

( * ) Notice: Subject to any disclaimer, the term of this patent is extended or adjusted under 35 U.S.C. 154(b) by 391 days.

(21) Appl. No.: 17/045,898

(22) PCT Filed: Mar. 8, 2019

(86) PCT No.: PCT/EP2019/055900
§ 371 (c)(1),
(2) Date: Oct. 7, 2020

(87) PCT Pub. No.: WO2019/197090
PCT Pub. Date: Oct. 17, 2019

(65) Prior Publication Data

US 2021/0138759 A1 May 13, 2021

(30) Foreign Application Priority Data

Apr. 9, 2018 (DE) ..... 10 2018 205 292.1

(51) Int. Cl.
*B31F 1/28* (2006.01)
*B65H 19/12* (2006.01)

(52) U.S. Cl.
CPC ..... *B31F 1/2804* (2013.01); *B65H 19/126* (2013.01); *B65H 2405/422* (2013.01); *B65H 2701/1762* (2013.01)

(58) Field of Classification Search
None
See application file for complete search history.

(56) References Cited

U.S. PATENT DOCUMENTS 4,266,998 A 5/1981 Tokuno
4,819,758 A 4/1989 Greene et al.
4,948,060 A 8/1990 Kurz et al.

FOREIGN PATENT DOCUMENTS

CN 102673964 A 9/2012
DE 3017036 A1 11/1980
(Continued)

*Primary Examiner* — Barbara J Musser
(74) *Attorney, Agent, or Firm* — McGlew and Tuttle, P.C.

(57) ABSTRACT

The invention relates to a corrugated board system, comprising at least one intermediate web dispensing device for dispensing at least one intermediate web, at least one cover web dispensing device for dispensing at least one cover web, at least one corrugated board production device arranged downstream of the at least one intermediate web dispensing device and cover web dispensing device for producing at least one corrugated board web laminated on one side from the at least one cover web and intermediate web, a laminating web dispensing device for dispensing a laminating web, a connecting device for connecting the at least one corrugated board web laminated on one side and the laminating web to one another upon formation of a corrugated board web laminated on both sides, at least one transport carriage for transporting at least one material roll along at least one movement path between at least one material roll store and the at least one intermediate web dispensing device, cover web dispensing device and/or laminating web dispensing device, and a control device for actuating the at least one transport carriage.

28 Claims, 11 Drawing Sheets

(56) References Cited

FOREIGN PATENT DOCUMENTS

| | | | |
|---|---|---|---|
| DE | 3731488 | A1 | 3/1988 |
| DE | 19919593 | A1 | 8/2000 |
| JP | H08333043 | A | 12/1996 |
| JP | 2008/0247513 | A | 10/2008 |

CORRUGATED BOARD SYSTEM

CROSS-REFERENCES TO RELATED APPLICATIONS

This application claims the priority of German Patent Application, Serial No. 10 2018 205 292.1, filed Apr. 9, 2018, the content of which is incorporated herein by reference in its entirety as if fully set forth herein.

FIELD OF THE INVENTION

The invention relates to a corrugated board system and to a method for producing corrugated board.

BACKGROUND OF THE INVENTION

Corrugated board systems are already known from the prior art. A disadvantage with these is often the handling of new material rolls for the corrugated board production or the handling of residual material rolls which can either be completely empty or still carry material.

JP 2008/0247513 A discloses a corrugated board system which comprises material roll conveying carriages. The material roll conveying carriages can be displaced rectilinearly between a rest position and operating position adjacent to unwinding devices by means of a respective chain drive. In the operating position, the material roll can be transferred to the corresponding unwinding device. This corrugated board system is extremely inflexible. It is not particularly user-friendly.

JP H08-333043 A discloses splicing arrangements with carrying arms for carrying material rolls. Around the carrying arms there runs a closed guide path in a hall floor for trolleys for transporting the material rolls. The trolleys are movable synchronously on the guide paths by means of an endless chain.

DE 38 29 931 A1 discloses a web feeding device for a corrugated board system. Under a splicing arrangement there is situated a first depression for receiving a transport device which guides away web rolls, while there are furthermore provided a second depression and a third depression for receiving a web roll feeding device and a further web roll feeding device. In each depression there is provided for example a pair of endless chains which carries a carriage for receiving a web roll.

DE 37 31 488 A1 discloses a corrugated board system. A conveying device for moving back and forth between a storage place and a location under pivoting aims of a roll stand is provided for paper rolls. The conveying device has a guide groove, which is arranged in the floor, and a carriage which is movable along the guide groove. Each end of a traction regulating chain is arranged at a front and rear end of a carriage.

DE 42 07 199 A1 discloses a corrugated board system having a web roll transfer device. A chassis having a web roll mounted thereon runs on rails and stops at a predetermined position during operation of the web roll transfer device.

DE 94 14 677 U1 discloses a paper processing unrolling device. A paper roll is transported on a transport device which is designed as an underfloor conveyor. The underfloor conveyor has a carriage with a loading plate for the paper roll.

DE 199 19 593 A1 discloses a transport device for paper rolls. Transport platforms can be moved along a closed transport path.

SUMMARY OF THE INVENTION

An object on which the invention is based is to overcome the deficiencies of the prior art. The intention in particular is to provide a corrugated board system which allows (residual) material rolls to be fed and/or discharged to or away from a corrugated board production line in a particularly simple manner. Furthermore, the intervention in a hall, in which the corrugated board system is accommodated, for the transport of the material rolls is intended to be kept to a minimum. A corresponding method is likewise intended to be provided.

The object is achieved according to the invention by a corrugated board system, comprising at least one intermediate web dispensing device for dispensing at least one intermediate web, at least one cover web dispensing device for dispensing at least one cover web, at least one corrugated board production device for producing at least one corrugated board web laminated on one side from the at least one cover web and intermediate web, wherein the at least one corrugated board production device is arranged downstream of the at least one intermediate web dispensing device and cover web dispensing device, a laminating web dispensing device for dispensing a laminating web, a connecting device for connecting the at least one corrugated board web laminated on one side and the laminating web to one another upon formation of a corrugated board web laminated on both sides, at least one transport carriage for transporting at least one material roll along at least one movement path between at least one material roll store and the at least one intermediate web dispensing device, cover web dispensing device and/or laminating web dispensing device, and a control device for actuating the at least one transport carriage.

The object is further achieved according to the invention by a method for producing corrugated board, comprising the steps of dispensing at least one intermediate web by means of at least one intermediate web dispensing device, dispensing at least one cover web by means of at least one cover web dispensing device, producing at least one corrugated board web laminated on one side from the at least one cover web and intermediate web by means of at least one corrugated board production device arranged downstream of the at least one intermediate web dispensing device and cover web covering device, dispensing a laminating web by means of a laminating web dispensing device, connecting the at least one corrugated board web laminated on one side to the laminating web upon formation of a corrugated board web laminated on both sides by means of a connecting device, transporting at least one material roll along at least one movement path between at least one material roll store and the at least one intermediate web dispensing device, cover web dispensing device and/or laminating web dispensing device by means of at least one transport carriage, and actuating the at least one transport carriage by means of a control device.

The core of the invention lies in the at least one transport carriage or trolley which is movable between at least one material roll store and the at least one intermediate web dispensing device or corrugated web dispensing device, cover web dispensing device and/or laminating web dispensing device in particular for transporting in or transporting away the material rolls, such as paper rolls or cardboard rolls, for the production of corrugated board.

The control device correspondingly actuates the at least one transport carriage. It is advantageously of electronic type. A signal transmission between the control device and the at least one transport carriage advantageously occurs wirelessly. The control device is preferably a central control device.

The at least one transport carriage preferably has an own communication device with a receiving unit for receiving external information items or signals, which are for example driving, target and/or environment information items, in particular from the control device.

It is expedient if, in addition to a receiving unit for receiving external information items, for example from the control device and/or an auxiliary controller, the communication device also comprises a transmitting unit for transmitting information items or signals, for example respective position, driving, environment and/or loading information items, to the control device. The transport carriage can preferably be sent to any desired locations. It is preferably movable in a rail-free manner.

A central control device means that the transport carriage can be implemented in a particularly simple manner or makes it cost-effective. The control device preferably coordinates the at least one transport carriage, advantageously a plurality of transport carriages.

The at least one transport carriage preferably has at least one own movement drive for, in particular direct or indirect, driving of at least one drivable running unit thereof. The at least one movement drive is preferably designed as an electric drive. It is preferably arranged directly or indirectly on a frame of the transport carriage. The at least one movement drive is advantageously in direct or indirect drive connection with the running unit(s) to be driven. It has a motor. The transport carriage can preferably be driven autonomously. The at least one transport carriage can preferably be actuated autonomously. It is in particular self-propelled.

It is expedient if the transport carriage comprises an energy storage unit which is configured for example as a battery or accumulator. In the case of discharge, stored chemical energy is preferably converted by electrochemical reaction into electrical energy. The transport carriage is thus independent of a power network or an indoor installation.

The running units of the transport carriage are preferably configured as wheel units which each comprise a wheel or a double wheel, for example. Alternatively, the running units are for example chain units or sliding units. Combinations are possible. The running units are preferably arranged or mounted directly or indirectly on the frame.

The at least one transport carriage is preferably movable horizontally on an underlying surface. The underlying surface is preferably formed from concrete, in particular fiber concrete. It preferably extends horizontally.

In a material roll receptacle of the transport carriage there can preferably be received a material roll which is formed by a rolled-up material web and is preferably required for producing corrugated board. The material roll receptacle is advantageously accessible from above. It preferably extends along the transport carriage. However, an empty inner carrying sleeve of a material roll can also be received in the material roll receptacle.

The material roll receptacle is preferably unlimited in the longitudinal direction. This configuration allows a relative longitudinal displacement between the transport carriage and a material roll which is to be received or dispensed and which is raised, in particular slightly, with respect to the transport carriage. The transport carriage can thus be moved in a simple manner along the material roll receptacle or the material roll under the raised material roll or can be moved away therefrom. There here occurs a displacement in the axial direction of the material roll. Collision points between the transport carriage and the material roll do not exist. The material roll receptacle is thus preferably open or free in its longitudinal direction.

The material roll receptacle advantageously has at the bottom at least one supporting element for support with respect to an underlying surface during compression of at least one spring unit. The transport carriage thus has a particularly long life. The at least one supporting element is preferably plate-shaped and dimensionally stable. It is preferably displaceable with respect to the frame, in particular under overload.

A material roll detection sensor of the transport carriage is configured for example as a weight sensor or optical sensor. It is expedient if the material roll detection sensor is assigned to the material roll receptacle. It is in particular capable of detecting whether the transport carriage is loaded or unloaded. It is advantageous if a corresponding information item can be sent to the central control device of the corrugated board system via the communication device.

Furthermore, the corrugated board system has for example a transverse cutting device for cutting the corrugated board web laminated on both sides into sheets. It is expedient if the corrugated board system additionally comprises a stacking device for stacking the sheets.

Further advantageous embodiments are specified in the dependent claims.

The embodiment, wherein the corrugated board system comprises at least one, in particular building-side, movement path specification arrangement for specifying the at least one movement path for the at least one transport carriage, wherein the at least one movement path specification arrangement preferably has at least one straight and/or curved section, leads to a particularly secure guidance of the at least one transport carriage. The at least one movement path specification arrangement is preferably designed as a marking and is applied for example to the underlying surface as a paint or ink marker. It is for example visible or invisible. Such a configuration requires only particularly small intervention in the hall receiving the corrugated board system.

It is expedient if, according to one embodiment, the movement path specification arrangement is formed at least partially by at least one energy supply coil which is advantageously arranged in the underlying surface. Alternatively, the movement path specification arrangement is at least partially formed by a wire which is arranged on or in the underlying surface.

A movement path detection device of the transport carriage detects the at least one movement path specification arrangement as a movement path. It is advantageously of optical type. It is preferably designed as a camera, sensor or the like. The transport carriage follows the movement path specification arrangement. The movement path specification arrangement is advantageously linear. It is for example interrupted or interruption-free.

Alternatively, the at least one transport carriage is for example movable along an imaginary transport path which is defined for example in a software and advantageously has at least one straight and/or curved section. An imaginary movement path is understood in particular to mean a movement path which is not predefined in a real or tangible manner. The imaginary movement path can also be referred to for example as a fictitiously predefined movement path. The at least one transport carriage can be controlled for example via a software controller.

In accordance with the invention, the movement path can be particularly well adapted to the requirements of the corrugated board system or to spatial conditions. The transport carriage is preferably steerable. It is capable of traveling straight. Also possible is cornering or turning around. This makes the transport carriage extremely flexible. The movement path is preferably arbitrarily predefinable, which simplifies the planning of the remaining infrastructure. The transport carriage is preferably movable in a manner which is free from fixedly predefined movement paths. It is for example capable of performing a cornering or turning around maneuver if for example its receiving unit receives corresponding, direct or indirect, information items, for example from the central control device. Steering of the transport carriage or deflection of at least one running unit can preferably be caused by a controller of the transport carriage or by corresponding signals.

For example, at least one running unit can be deflected. This can occur for example in a targeted manner by means of an actuatable steering device. Alternatively, for example, there are two movement drives which can be actuated separately or independently of one another and are in drive connection with corresponding running units. With identical actuation of the movement drives, the transport carriage travels straight, whereas, with different actuation of the movement drives, said carriage corners or makes a turning around maneuver. The movement drives can be actuated independently of one another and differently. They can be driven in opposite directions of rotation.

The embodiment, wherein the corrugated board system is configured such that the at least one transport carriage is movable at least in regions so as to be laterally offset with respect to the at least one movement path specification arrangement, allows particularly simple loading or unloading of the transport carriage. Alternatively, the transport carriage is capable of axially displacing the material position. A lateral offset of the at least one transport carriage with respect to the at least one movement path specification arrangement of between 2 cm and 15 cm, preferably between 3 cm and 8 cm, is advantageously possible.

The at least one movement path specification arrangement is preferably closed as a circuit at least in regions. It is expedient if the at least one movement path specification arrangement has at least one material roll feed partial movement path and at least one material roll discharge partial movement path. The at least one material roll feed partial movement path is advantageously configured at least in regions as a one-way street. The at least one material roll discharge partial movement path is preferably configured at least in regions as a one-way street. This corrugated board system is particularly economical. It is expedient if a closed, in particular fully automatic, material roll or transport carriage circuit is present. It is advantageous if at least one path can be driven over in opposite directions by the at least one transport carriage. At least one path can preferably be driven over only in one direction by the at least one transport carriage. The at least one movement path specification arrangement advantageously comprises at least one material roll or transport carriage circuit. The at least one material roll feed partial movement path and material roll discharge partial movement path are advantageously separated from one another in the case of a configuration as a one-way street.

The corrugated board system comprising at least one feed-discharge path which runs between the at least one material roll store and the at least one intermediate web dispensing device, cover web dispensing device and/or laminating web dispensing device and which is designed at least in regions as a two-way traffic path for moving the at least one transport carriage in opposite directions and further comprising at least one distribution path for guiding the at least one transport carriage to the intended dispensing device and advantageously for returning the at least one transport carriage, wherein the at least one distribution path is arranged between the at least one material roll store and the at least one intermediate web dispensing device, cover web dispensing device and/or laminating web dispensing device, is particularly economical. The at least one distribution path as claimed in dependent claim 5 is for example configured at least in certain regions as an, in particular endless, one-way street and/or two-way street for the at least one transport carriage.

It is expedient if the at least one distribution path is adjoined by at least one cover web path, intermediate web path and/or laminating web path which leads to the cover web dispensing device, intermediate web dispensing device or laminating web dispensing device or to the respective unrolling unit thereof. It is advantageous if the at least one cover web path, intermediate web path and/or laminating web path is configured at least in regions as an, in particular endless, one-way street and/or two-way street for the at least one transport carriage.

The embodiment, wherein the corrugated board system comprises at least one, in particular building-side, position marking for determining the position of the at least one transport carriage in the case of an adjacent arrangement between the at least one position marking and the at least one transport carriage, affords further improved guidance of the at least one transport carriage. In particular, such a position marking is arranged adjacent to a switch, crossing and the like. It is preferably again configured as a paint marker.

A plurality of transport carriages are advantageously present. This corrugated board system is also particularly economical and efficient. If a plurality of transport carriages are present, they can preferably be actuated or moved differently. The transport carriages preferably jointly use at least in part the at least one feed-discharge path and/or distribution path.

The corrugated board system comprising at least one transport carriage buffer region arranged upstream of the at least one intermediate web dispensing device, cover web dispensing device and/or laminating web dispensing device, is likewise particularly economical and efficient. Waiting times for transporting in or transporting away new material rolls are thus avoidable. It is expedient if the at least one transport carriage buffer region is arranged adjacent to the at least one intermediate web discharge device, cover web dispensing device and/or laminating web discharge device.

The corrugated board system comprising a safety arrangement for safeguarding the at least one movement path at least in regions, is particularly safe. In particular, the control device also performs the monitoring of at least one risk region or protective region. An access control to the at least one protective region is for example effected electronically-optically, in particular by means of at least one (laser) light barrier or a light curtain. The at least one transport carriage situated in the protective region is then advantageously put immediately out of operation if a risk is detected.

Enabling after a risk has been detected preferably takes place by an operator, for example by way of an acknowledgement. Alternatively, enabling is possible automatically by means of a transponder on the operator, in particular on the clothing thereof. As soon as the operator leaves the protective region, the latter is advantageously enabled again and the at least one transport carriage put out of operation is put back into operation. The control device preferably controls a central safety concept, with the result that the at least one transport carriage can be implemented in a comparatively simple manner.

The embodiment, wherein the corrugated board system comprises at least one, in particular building-side, electrical charging point along the at least one movement path for supplying the at least one transport carriage with electrical energy on the at least one movement path, allows a substantially interruption-free movement of the at least one transport carriage. The charging advantageously occurs inductively, in particular by means of at least one coil.

It is expedient if the energy storage unit of the transport carriage can be charged, in particular inductively. The energy storage unit can advantageously be charged with the transport carriage moving and/or stationary.

The corrugated board system configured such that the control device controls a central access control is also extremely safe.

It is advantageous if the at least one intermediate web dispensing device, cover web dispensing device and/or laminating web dispensing device are/is designed as a splicing device.

Dependent claims 2 to 21 preferably also relate to advantageous developments of the method as claimed in claim 22.

Two preferred embodiments of the invention will be described by way of example below with reference to the appended drawing.

DESCRIPTION OF THE PREFERRED EMBODIMENTS

Figure 1:
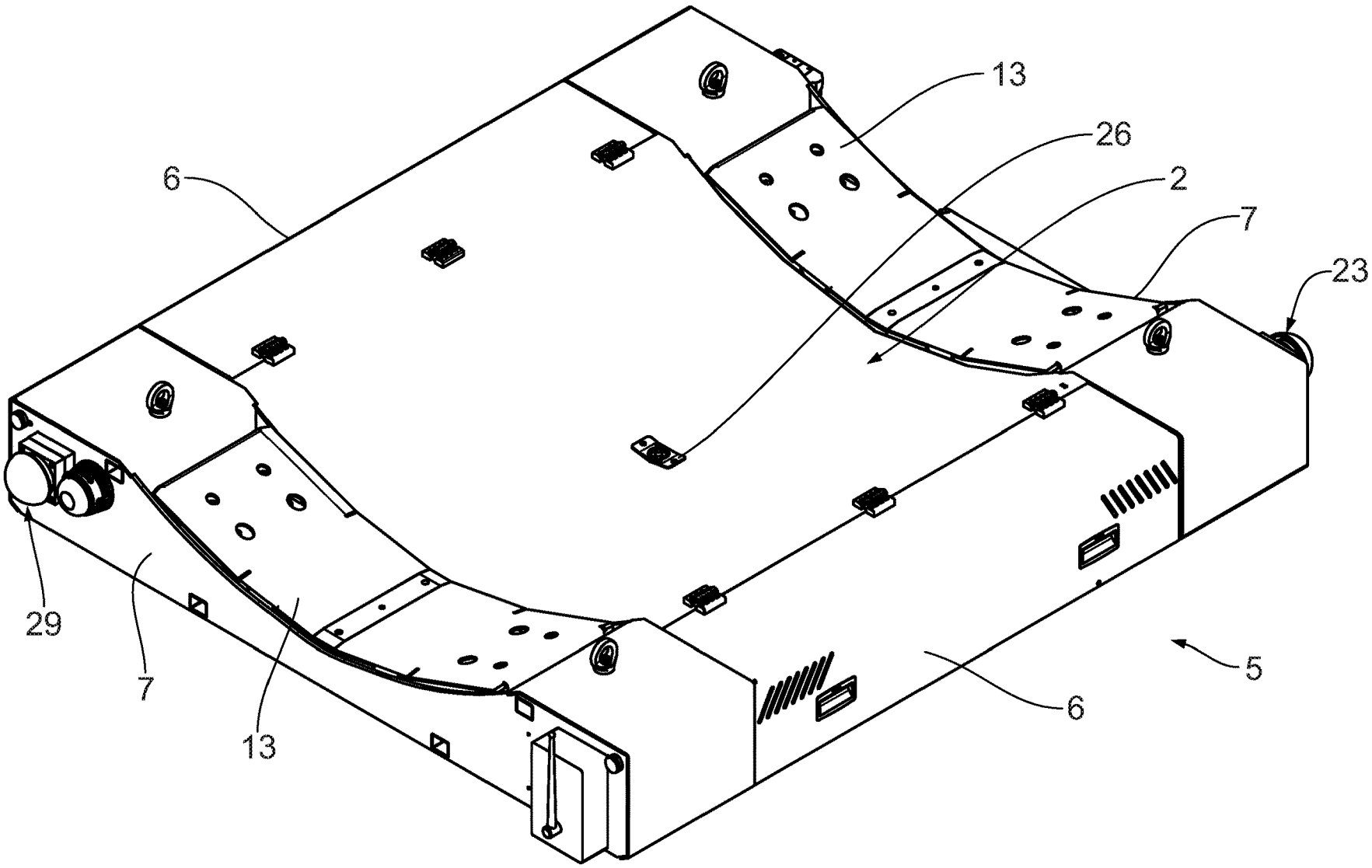
FIG. 1 shows a perspective view of a transport carriage.
Figure 2:
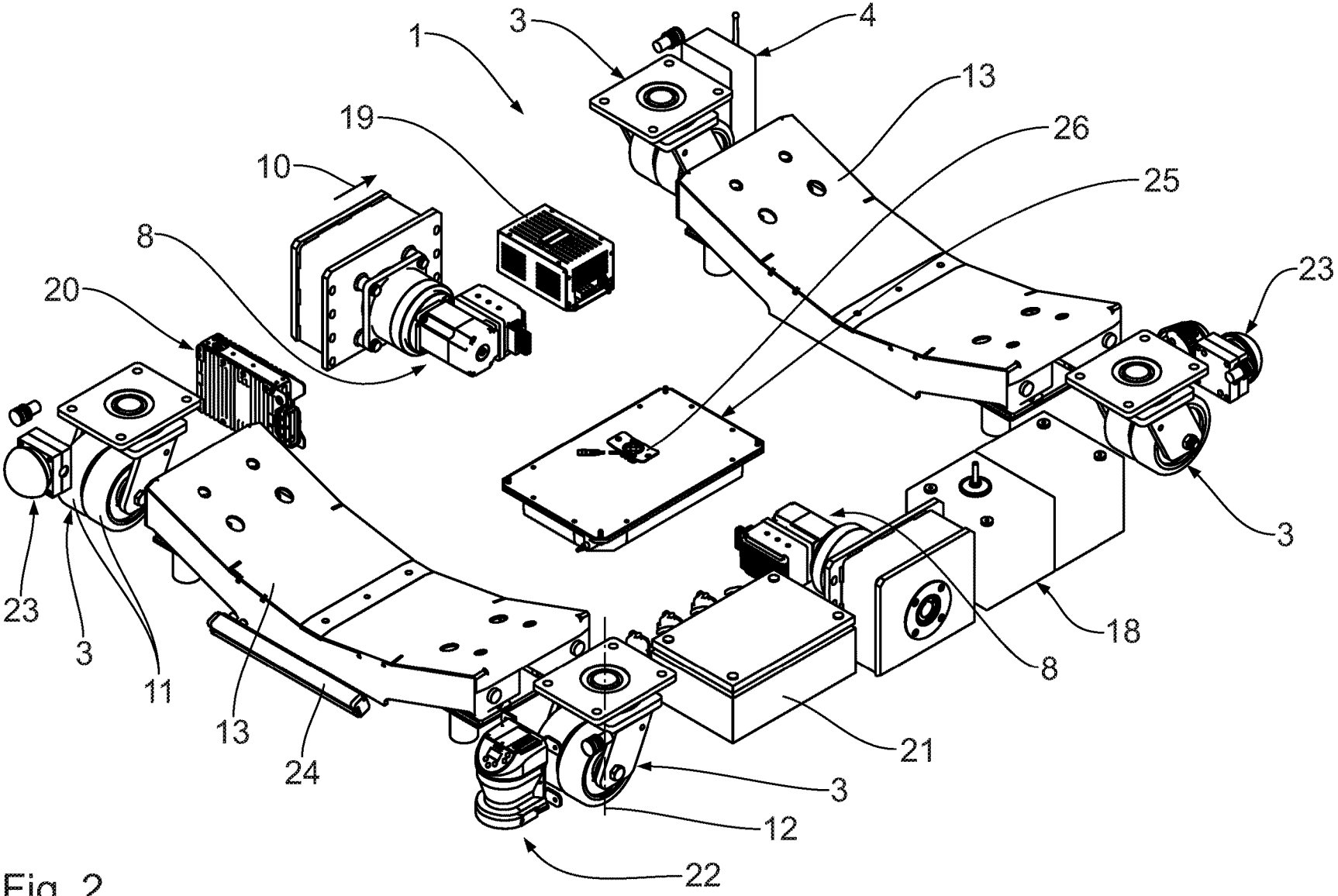
FIG. 2 shows an exploded view which illustrates the essential parts of the transport carriage shown in FIG. 1.
Figure 3:
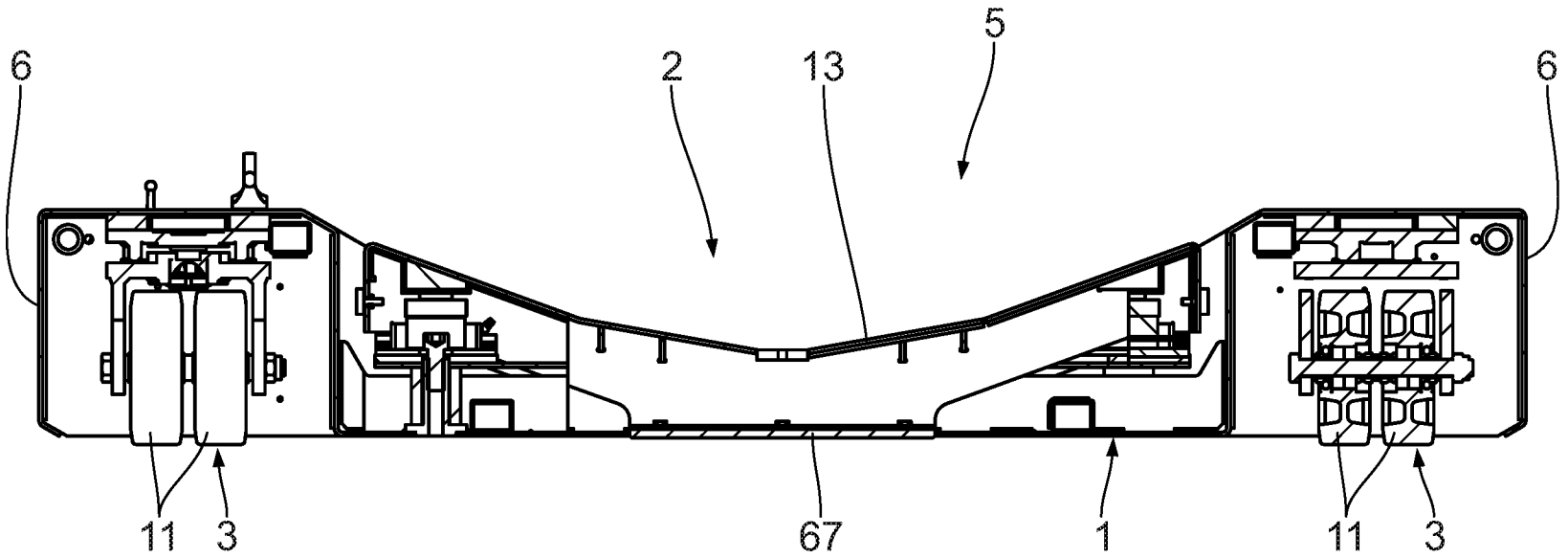
FIG. 3 shows a cross section through the transport carriage shown in FIGS. 1 and 2.

Referring first of all to FIGS. 1 to 5, the construction of a paper roll transport carriage 5 will be described. The paper roll transport carriage 5 has a rigid frame 1, which is rack-like or chassis-like. The frame 1 bears a paper roll receptacle 2 for a finite rolled-up paper web, and a plurality of wheel units 3 for moving the paper roll transport carriage 5 on an underlying surface, and also a communication device 4.

The paper roll transport carriage 5 can be set in movement in dependence on signals or information items received via the communication device 4. Furthermore, its speed can thus for example be predefined. Path or target information items can correspondingly also be transmitted to the paper roll transport carriage 5. The paper roll transport carriage 5 can be moved with a straight or curved movement.

The frame 1 has two longitudinal sides 6 and two transverse sides 7. The longitudinal sides 6 run parallel to one another. They extend parallel to the paper roll receptacle 2.

The transverse sides 7 also extend parallel to one another. The longitudinal sides 6 and the transverse sides 7 run at right angles to one another.

An autonomous movement drive 8, which comprises an electric motor having a drive shaft, is arranged adjacent to each longitudinal side 6 on the frame 1.

A drive running wheel 9 which is rotatably or rotationally drivably mounted is in drive connection with each movement drive 8 or its drive shaft. The axes of rotation of the drive running wheels 9 are aligned with one another. They extend perpendicularly to the longitudinal sides 6. The drive running wheels 9 are situated in the center with respect to a longitudinal direction 10 of the paper roll transport carriage 5. They are unsteerable.

Furthermore, a steering wheel unit 11 is arranged at each corner region of the frame 1 on the frame 1, each of the steering wheel units comprising a twin wheel. The twin wheels are rotatably mounted. Each steering wheel unit 11 can be independently deflected about a vertical steering axis 12. The steering wheel units 11 are freely deflectable, in particular through 360°. The steering axes 12 run parallel to one another.

The paper roll receptacle 2 is formed by two channel parts 13 which are arranged spaced apart from one another and which are each mounted so as to be vertically displaceable on the frame 1. The channel parts 13 extend adjacent to the transverse sides 7 between the longitudinal sides 6. Their lowest receiving point is situated centrally between the longitudinal sides 6. They are of symmetrical design. The channel parts 13 have their highest points adjacent to the longitudinal sides 6 of the frame 1. They are open adjacently to the transverse sides 7 of the frame 1 or in the longitudinal direction.

The paper roll receptacle 2 bears at the bottom at least one horizontally extending support plate 67.

Between the frame 1 and the channel part 13 arranged thereabove, spring units 14 are arranged. Each spring unit 14 is formed by a helical compression spring which is preloaded and compressible. Helix axes 15 of the spring units 14 run vertically. The spring units 14 are each supported at the top on the frame 1. Furthermore, in each case one of the channel parts 13 lies on at least two spring units 14 at the top. The maximum spring travel of the spring units 14 is advantageously in each case between 3 mm and 10 mm, preferably between 5 mm and 8 mm.

Between the frame 1 and each channel part 13 there are arranged guides 16 which allow a vertical displacement of each channel part 13 with a change in the length of the associated spring units 14, but prevent or reduce a horizontal displacement of each channel part 13 with respect to the frame 1. Each guide 16 is formed by a guide pin 17 which extends vertically and engages from above in an associated spring unit 14.

Additionally arranged on the frame 1 is an accumulator 18. The accumulator 18 is a rechargeable store for electrical energy for the movement drives 8.

Also arranged on the frame 1 is a voltage regulator 19. The voltage regulator 19 is electrically connected to the accumulator 18. It is capable of balancing out fluctuations in the electrical input voltage of the accumulator 18. The voltage regulator 19 is advantageously of electronic type. It is additionally in electrical connection with the two movement drives 8.

On the frame 1 there is furthermore arranged a controller 20 which is capable of actuating the two movement drives 8 independently of one another. The controller 20 is additionally in signal connection with the communication device 4.

Also arranged on the frame 1 is a terminal box 21. The electronic or electrical components of the paper roll transport carriage 5 are electrically connected to one another via the terminal box 21.

On the frame 1 there is furthermore arranged, in a front corner region, a safety device 22 which is formed as a scanner, in particular a laser scanner. The safety device 22 is in signal connection with the controller 20. It is capable of stopping the paper roll transport carriage 5 if a risk is detected.

Furthermore, an emergency shutoff device 23 is arranged at each end side of the paper roll transport carriage 5. Each emergency shutoff device 23 is capable upon actuation of immediately switching off the movement drives 8 or immediately interrupting the current supply thereto.

A movement path detection device 24 which is configured as a sensor is arranged adjacent to the front transverse side 7 on the frame 1 centrally at the front. The movement path detection device 24 is of elongate design and extends horizontally. It runs perpendicular to the longitudinal direction 10 of the paper roll transport carriage 5. It is capable of detecting a predefined movement path.

The frame 1 additionally holds an inductive energy transmission device 25. The energy transmission device 25 is in electrical connection with the accumulator 18. It is arranged in a central region of the paper roll transport carriage 5.

The energy transmission device 25 bears at the top a paper roll detection sensor 26. The paper roll detection sensor 26 is capable of detecting whether the paper roll transport carriage 5 is loaded or unloaded. It is situated in the paper roll receptacle 2.

The paper roll transport carriage 5 can be moved by energizing the at least one movement drive 8. The necessary electrical energy comes from the accumulator 18. The movement drives 8 indirectly receive corresponding driving signals via the movement path detection device 24 and/or via the communication device 4.

If the two drive running wheels 9 are driven oppositely to an identical degree, the paper roll transport carriage 5 rotates on the spot. If the one drive running wheel 9 is driven more strongly than the other drive running wheel 9, the paper roll transport carriage 5 makes a cornering movement. Here, the steering wheel units 11 are automatically adjusted about the respective steering axis 12. If the two drive running wheels 9 are driven identically and in the same direction, the paper roll transport carriage 5 travels straight. The steering wheel units 11 are automatically correspondingly set to a straight-ahead movement.

Figure 5:
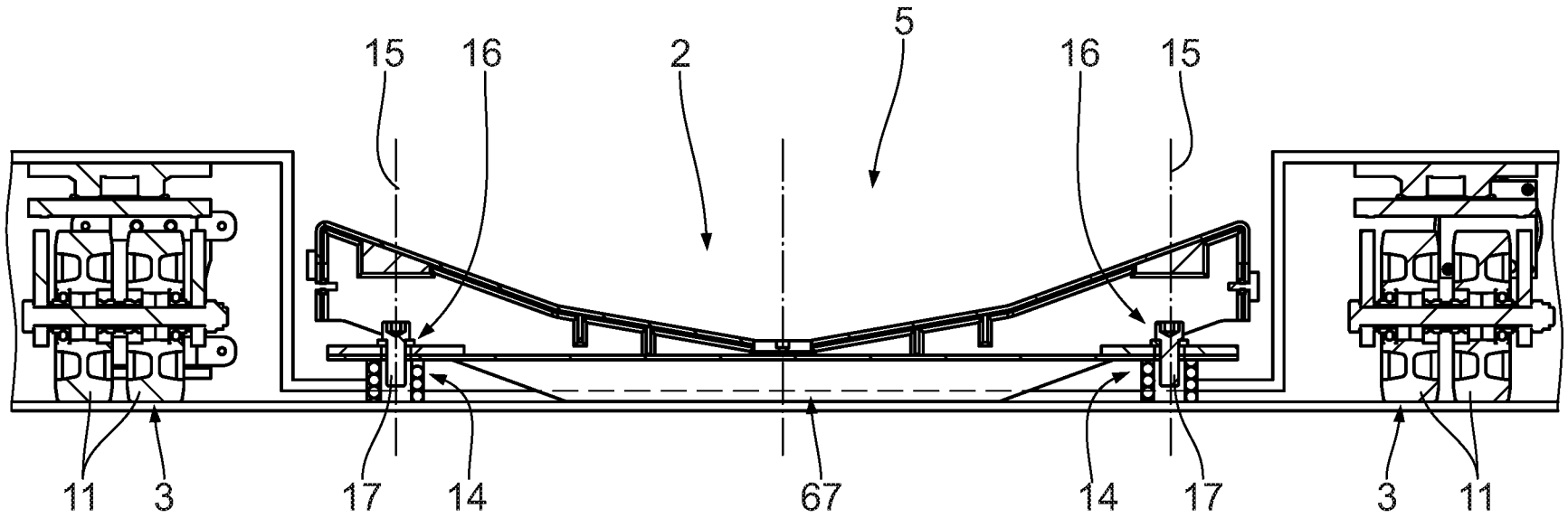
FIG. 5 shows a cross section corresponding to FIG. 4, with its spring units now being in a loaded, compressed state.
Figure 6:
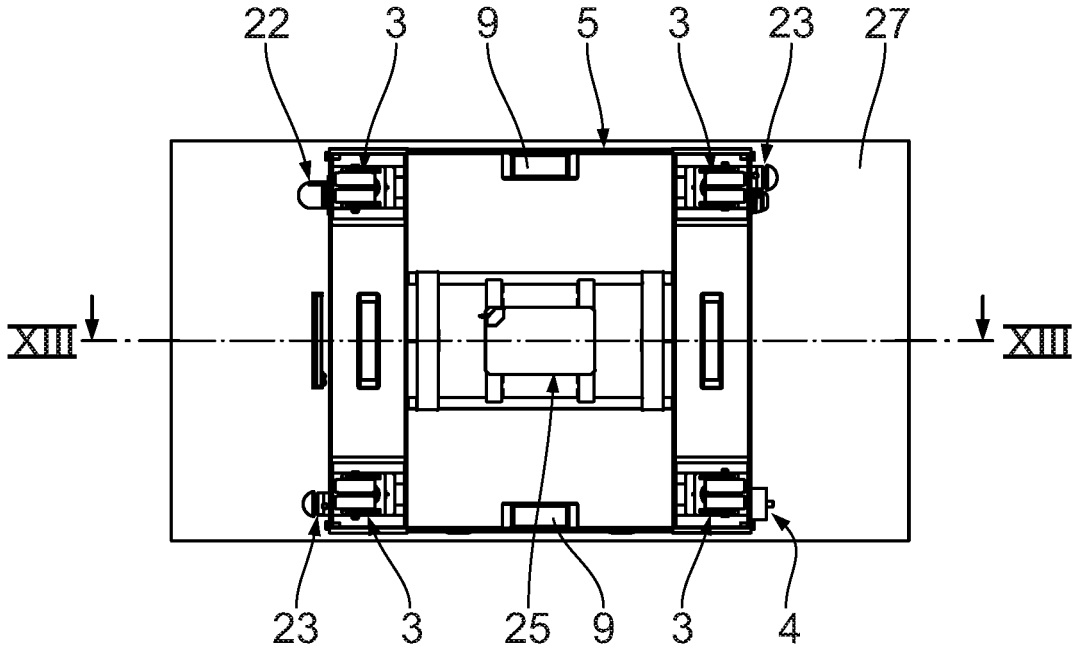
FIG. 6 shows a view from below, which shows the transport carriage illustrated in FIGS. 1 to 5 and a material roll arranged thereon.
Figure 7:
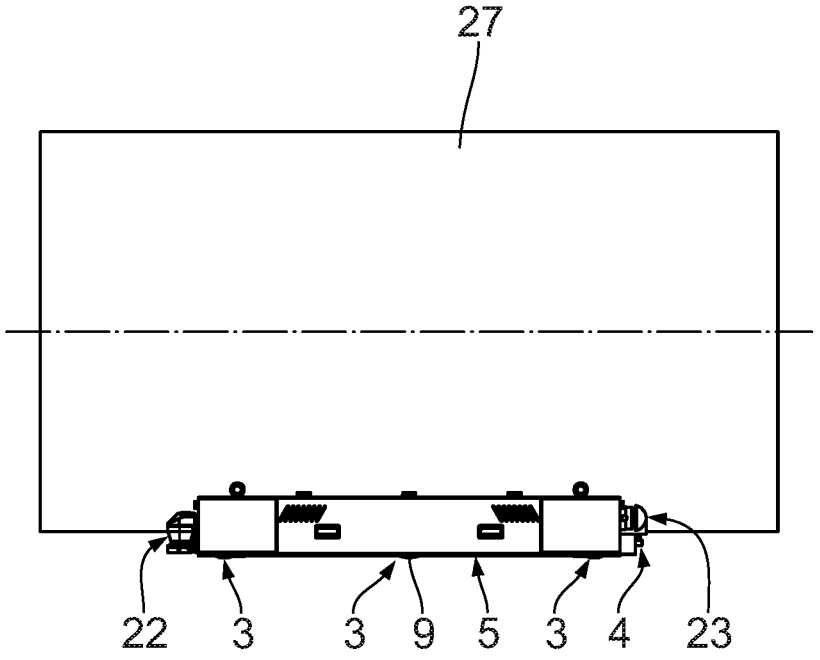
FIG. 7 shows a side view of the arrangement of transport carriage and material roll shown in FIG. 6.
Figure 8:
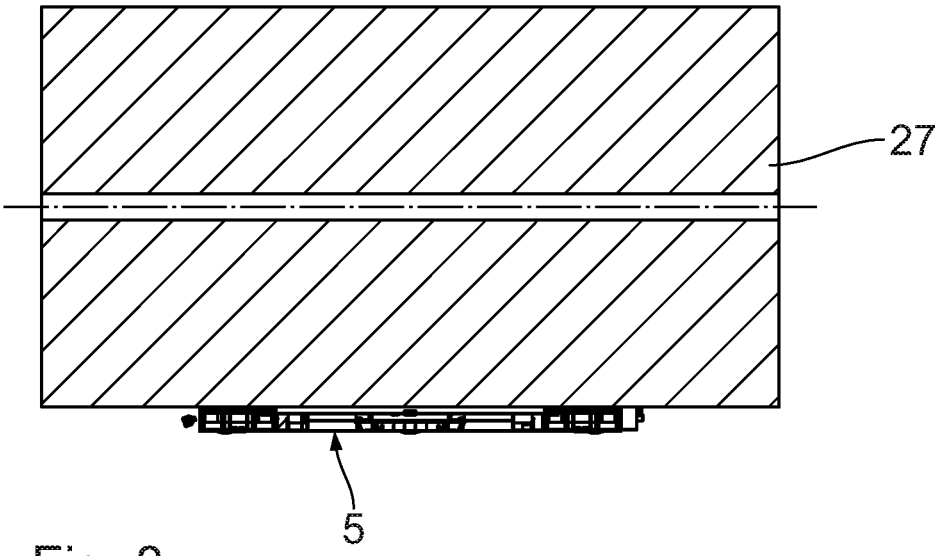
FIG. 8 shows a longitudinal section through the arrangement of transport carriage and material roll shown in FIG. 6 corresponding to the section line VIII-VIII in FIG. 6.
Figure 9:
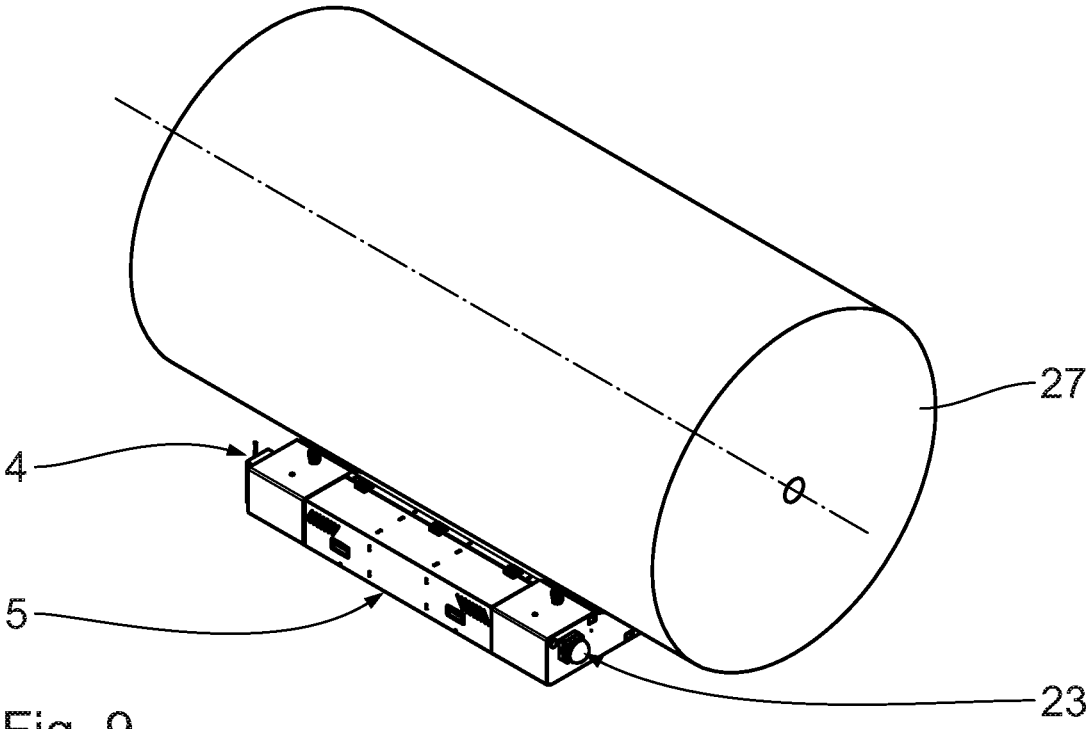
FIG. 9 shows a perspective view of the arrangement of transport carriage and material roll shown in FIGS. 6 to 8.
Figure 10:
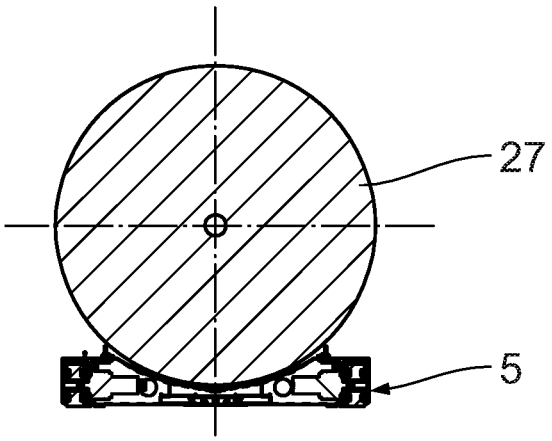
FIG. 10 shows a cross section through the arrangement of transport carriage and material roll shown in FIGS. 6 to 9.
Figure 11:
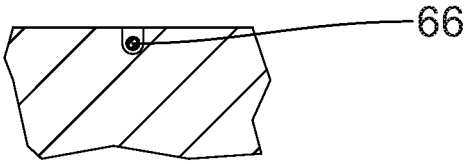
FIG. 11 shows an energy supply coil arranged in an underlying surface.
Figure 12:
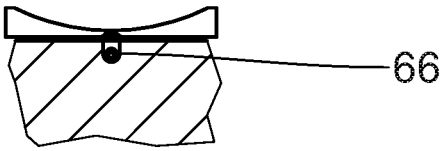
FIG. 12 shows a view which illustrates the energy supply coil shown in FIG. 11 and a transport carriage situated above it.
Figure 13:
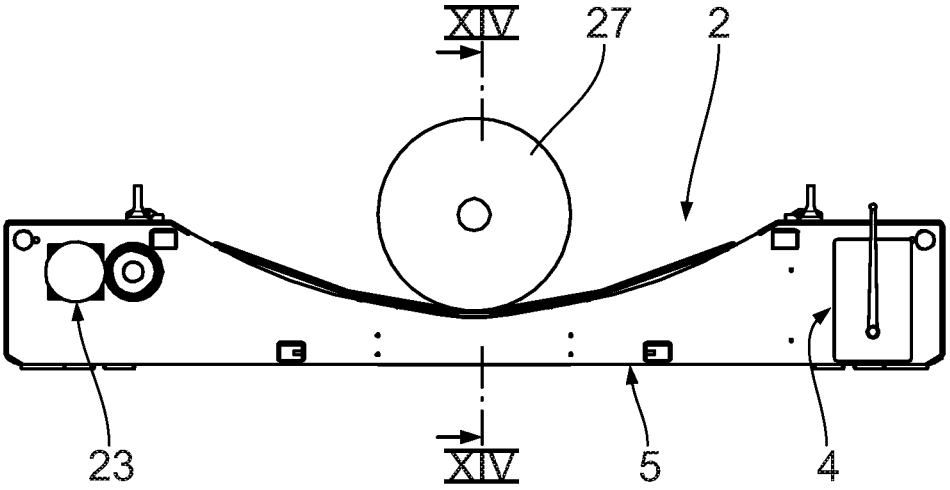
FIG. 13 shows a further arrangement of an illustrated transport carriage and a material roll, wherein the material roll is reduced in its outside diameter by comparison with FIGS. 6 to 10.
Figure 14:
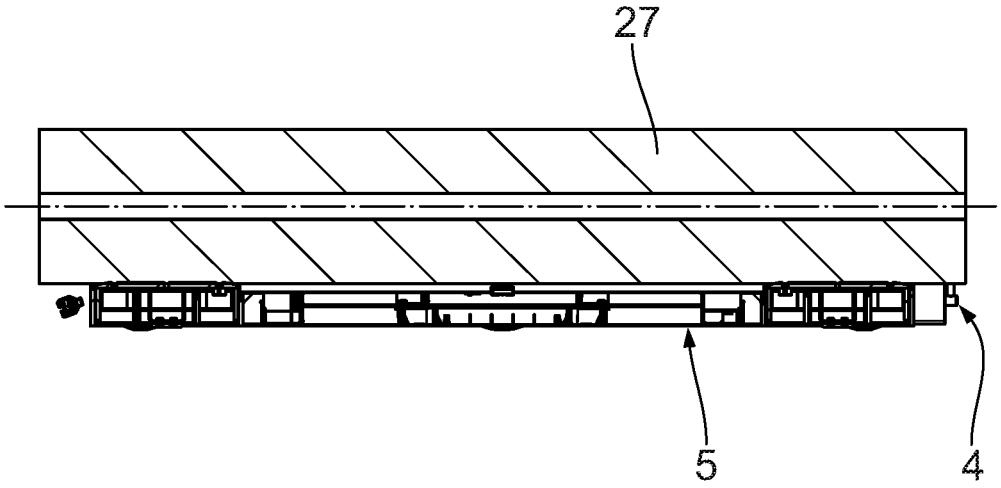
FIG. 14 shows a longitudinal section through the arrangement of transport carriage and material roll shown in FIG. 13 corresponding to the section line XIV-XIV in FIG. 13.

If the paper roll transport carriage 5 is loaded with a paper roll 27, upon overload the channel parts 13 are displaced downwardly in a guided manner against the spring force of the spring units 14 and with respect to the frame 1 (FIG. 5). Here, the at least one supporting plate 67 comes into contact with the underlying surface. The paper roll transport carriage 5 is thus protected.

The preloaded spring units 14 still hold the paper roll 27 or the channel parts 13 in position even under a maximum paper roll weight, such as five tonnes. In the case of an overload, dynamic or static, the spring units 14 yield until the paper roll receptacle 2 is compressed to such an extent that the at least one supporting plate 67 strikes the underlying surface and thus dissipates the overload directly into the underlying surface without thereby overloading the paper roll transport carriage 5.

The paper roll 27 arranged in the paper roll receptacle 2 lies on the paper roll detection sensor 26, which thus detects a loading with the paper roll 27. It extends horizontally.

The paper roll 27 lies on the channel parts 13. The channel parts 13 bear over a partial circumferential region of the paper roll 27 against the latter at the bottom and/or laterally. The paper roll 27 projects, advantageously uniformly, with respect to the paper roll transport carriage 5 in the longitudinal direction 10 and/or in the transverse direction. In its longitudinal direction or axial direction and in its transverse direction, that is to say perpendicular to its longitudinal direction, the paper roll 27 completely overlaps the paper roll transport carriage 5.

Figure 4:
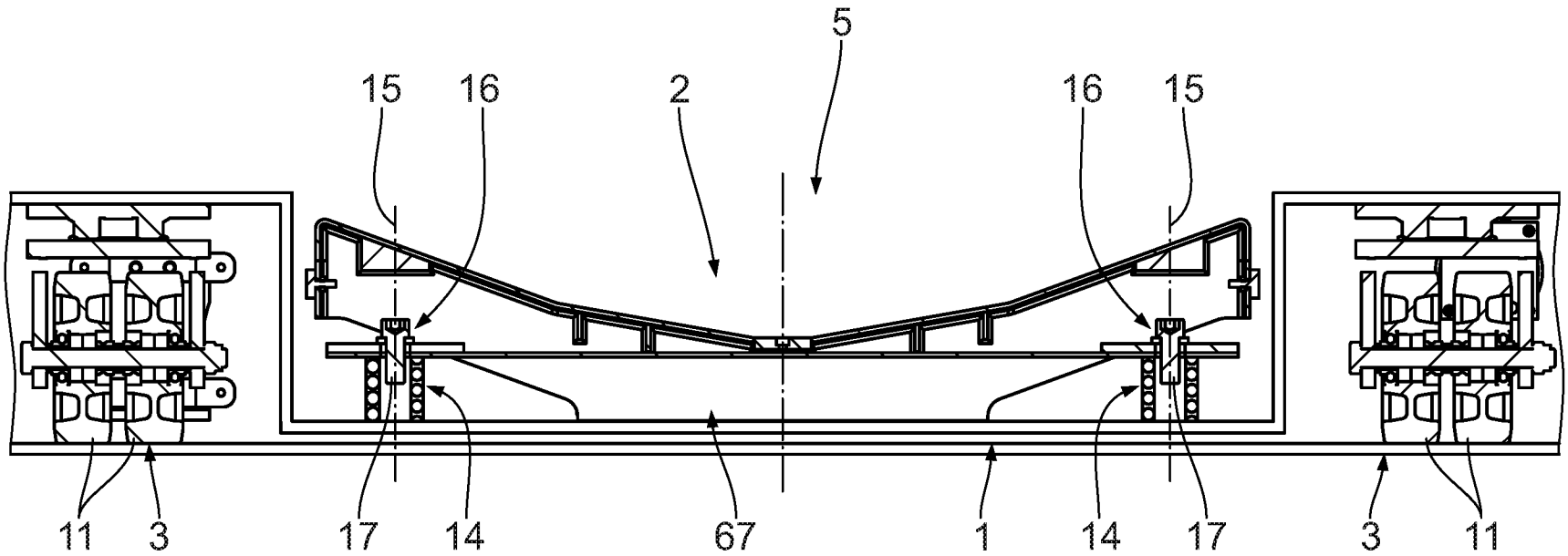
FIG. 4 shows a further cross section through the transport carriage shown in FIGS. 1 to 3, with its spring units being in an unloaded state.

Upon unloading of the paper roll 27, the spring units 14, if compressed as a result of overload, rebound again and displace the channel parts 13 upwardly in a guided manner (FIG. 4).

Each unrolling unit of each splicing device/web dispensing device advantageously has an unrolling arm arrangement for rotatably mounting the respective paper roll 27. The respective unrolling arm arrangement preferably describes at least partially a circular arc movement, in particular during lifting, which leads to a particularly precise reception of the paper roll 27, even with different diameters, in the paper roll receptacle 2. This results in an offset of the paper roll center with respect to the mandrel of the respective unrolling unit.

In a corrugated board system, which will be explained below with reference to FIG. 15, use is made of a plurality, preferably between 15 and 25, of the paper roll transport carriages 5. They are used to feed paper rolls 27 to a corrugated board production line of the corrugated board system for producing corrugated board and also to transport them away again.

The corrugated board production line extends along a corrugated board production direction. It comprises a first corrugated board production device 28 for producing a first corrugated board web laminated on one side.

Upstream of the first corrugated board production device 28 there are arranged a first cover web splicing device 29 and a first intermediate web splicing device 30. The first cover web splicing device 29 comprises a first unrolling unit for unrolling a finite first cover web from a first cover web roll and a second unrolling unit for unrolling a finite second cover web from a second cover web roll. The finite first cover web and second cover web are connected to one another by means of a connecting and cutting unit of the first cover web splicing device 29 to provide an endless first cover web.

The first intermediate web splicing device 30 is formed in a corresponding manner to the first cover web splicing device 29. It comprises a third unrolling unit for unrolling a finite first intermediate web from a first intermediate web roll and a fourth unrolling unit for unrolling a finite second intermediate web from a second intermediate web roll. The finite first intermediate web and second intermediate web are connected to one another by means of a connecting and cutting unit of the first intermediate web splicing device 30 to provide an endless first intermediate web.

The endless first cover web and the endless first intermediate web are fed to the first corrugated board production device 28.

To produce an endless first corrugated web having a corrugation from the endless first intermediate web, the first corrugated board production device 28 comprises a first fluting roller arrangement having a first fluting roller and a second fluting roller. The fluting rollers form a first roller gap for guiding through and fluting the endless first intermediate web.

To connect the endless first cover web to the endless corrugated first intermediate web or corrugated web to form the endless first corrugated board web laminated on one side, the first corrugated board production device 28 has a first glue application device which preferably comprises a glue metering roller, a glue container and a glue application roller. In order to guide through and glue the endless first corrugated web, the glue application roller forms a gap with the first fluting roller. The glue situated in the glue container is applied to peaks of the corrugation of the endless first corrugated web via the glue application roller. The glue metering roller bears against the glue application roller and serves to form a uniform glue layer on the glue application roller.

The endless first cover web is then joined together with the endless first corrugated web, which is provided with glue from the glue container, in the first corrugated board production device 28 to produce the first corrugated board web laminated on one side.

In order to press the endless first cover web against the endless first corrugated web which is provided with glue and which in turn bears in regions against the first fluting roller, the first corrugated board production device 28 has a first pressing-on module. The first pressing-on module is advantageously configured as a pressing-on belt module. It is arranged above the first fluting roller. The first pressing-on module has two first deflection rollers and an endless first pressing-on belt which is guided around the two first deflection rollers.

The first fluting roller engages in a space between the two first deflection rollers of the first pressing-on module from below in certain regions, with the result that the first pressing-on belt is deflected by the first fluting roller. The first pressing-on belt presses against the endless first cover web, which in turn is pressed against the endless first corrugated web which is provided with glue and which bears against the first fluting roller.

For intermediate storage and buffering of the endless first corrugated board web laminated on one side, the latter is fed via a first vertical-transport device to a first storage device, where it forms loops.

Furthermore, the corrugated board production line has a second corrugated board production device 31 which is formed in a corresponding manner to the first corrugated board production device 28.

Arranged upstream of the second corrugated board production device 31 are a second cover web splicing device 32 and a second intermediate web splicing device 33 which are formed in a corresponding manner to the first cover web splicing device 29 or the first intermediate web splicing device 30.

The second cover web splicing device 32 comprises a fifth unrolling unit for unrolling a finite third cover web from a third cover web roll and a sixth unrolling unit for unrolling a finite fourth cover web from a fourth cover web roll. The finite third cover web and fourth cover web are connected to one another by means of a connecting and cutting unit of the second cover web splicing device 32 to provide an endless second cover web.

The second intermediate web splicing device 33 comprises a seventh unrolling unit for unrolling a finite third intermediate web from a third intermediate web roll and an eighth unrolling unit for unrolling a finite fourth intermediate web from a fourth intermediate web roll. The finite third intermediate web and fourth intermediate web are connected to one another by means of a connecting and cutting unit of the second intermediate web splicing device 33 to provide an endless second intermediate web.

The second corrugated board production device 31 is capable of producing an endless second corrugated board web laminated on one side from the endless second cover web and intermediate web.

The second corrugated board web laminated on one side is fed to a second storage device, where it forms loops.

The corrugated board production line additionally has a laminating web splicing device 34 which comprises a ninth unrolling unit for unrolling a finite first laminating web from a first laminating web roll and a tenth unrolling unit for unrolling a finite second laminating web from a second laminating web roll. The finite first laminating web and the finite second laminating web are connected to one another by means of a connecting and cutting unit of the laminating web splicing device 34 to provide an endless laminating web.

Downstream of the storage devices and the laminating web splicing device 34, the corrugated board production line has a preheating device which comprises three preheating rollers arranged above one another. The endless corrugated board webs laminated on one side and the endless laminating web are fed to the preheating devices.

Downstream of the preheating device, the corrugated board production line has a gluing unit with gluing rollers which are partially dipped into a respective glue bath. Against each gluing roller there bears a glue metering roller in order to form a uniform glue layer on the adjacent gluing roller. The first corrugated board web laminated on one side has its corrugated web in contact with a first gluing roller such that the corrugation of this corrugated web is provided with glue from the glue bath. The second corrugated board web laminated on one side has its corrugated web in contact with a second gluing roller such that the corrugation of this corrugated web is provided with glue from the associated glue bath.

Downstream of the gluing unit, the corrugated board production line has a connecting device 35 which is formed as a heating pressing-on device and comprises a horizontally extending heating table. Adjacent to the heating table there is arranged an endless pressing-on belt which is guided around guide rollers. Between the pressing-on belt and the heating table there is formed a pressing-on gap through which the corrugated board webs laminated on one side and the endless laminating web are guided to form the endless, here five-layer, corrugated board web.

Downstream of the connecting device 35, the corrugated board production line has a short transverse cutting device.

Downstream of the short transverse cutting device, the corrugated board production line comprises a longitudinal cutting/grooving device.

Downstream of the longitudinal cutting/grooving device, the corrugated board production line has a transverse cutting device in order to produce sheets from the endless corrugated board web or from partial webs thereof.

Downstream of the transverse cutting device there is arranged a conveyor belt device in order to convey the sheets further. Downstream of the conveyor belt device there is arranged a depositing device.

Situated adjacent to the corrugated board production line is a paper roll store 36 of the corrugated board system in which a multiplicity of advantageously different paper rolls 27 for the splicing devices 29, 30, 32, 33, 34 are stored.

Adjacent to the paper roll store 36 there is situated a transfer point 36*a*, where the paper rolls 37 are transferred from the paper roll store 36 to the respective paper roll transport carriage 5, for example in a manual or automated manner.

Figure 15:
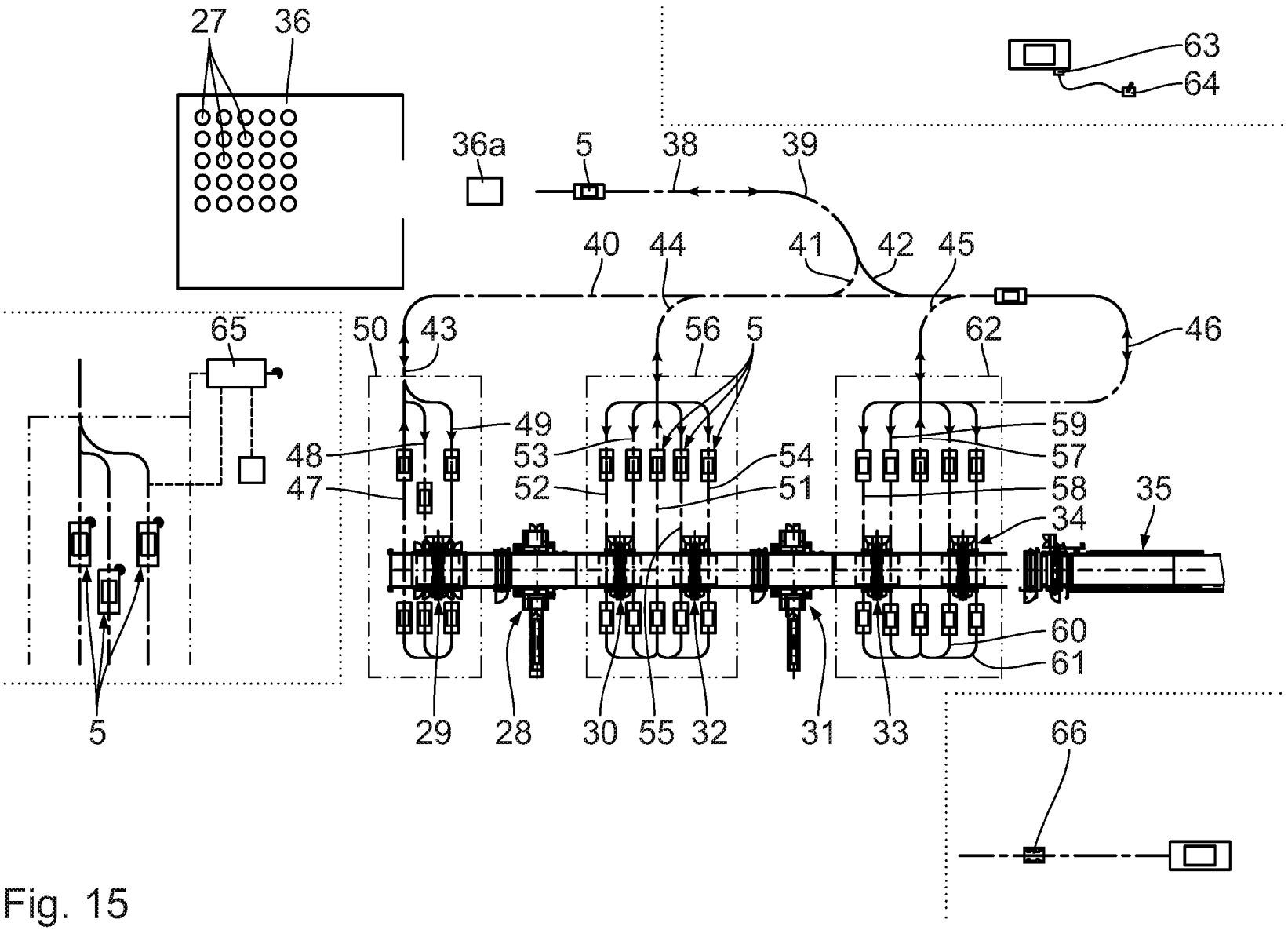
FIG. 15 shows a partial plan view of a simplified corrugated board system according to the invention according to a first embodiment in which transport carriages and their movement paths are also illustrated.

In FIG. 15, movement path markings 38 are also illustrated, these indicating and predefining the movement paths of the paper roll transport carriages 5 in the corrugated board system. The movement path markings 38 are visible and applied as a paint marker to a planar underlying surface carrying the corrugated board system. They can be recognized by the movement path detection devices 24 of the paper roll transport carriages 5. In normal operation, the paper roll transport carriages 5 follow while traveling the movement path markings 38, which comprise curves, switches, crossings and straight sections. The central control device 65 predefines how the paper roll transport carriage 5 is intended to travel at switches, crossings or the like. The maximum movement speed of the paper roll transport carriages 5 is preferably 0.4 m/s.

As shown in FIG. 15, the transfer point 36*a* is adjoined by a feed-discharge path 39, where the paper roll transport carriages 5 move in opposite directions during the operation of the corrugated board system. The feed-discharge path 39 has, adjoining the transfer point 36*a*, a straight section and, at the end side, a bend section.

The bend section of the feed-discharge path 39 is adjoined by a distribution path 40. On the distribution path 40, the paper roll transport carriages 5 travel in mutually opposite directions during the operation of the corrugated board system. The distribution path 40 extends parallel to the straight section of the feed-discharge path 39 and to the corrugated board production line. It runs between the straight section of the feed-discharge path 39 and the corrugated board production line. The feed-discharge path 39 laterally adjoins the distribution path 40 at a distance from ends of the distribution path 40.

Between the distribution path 40 and the feed-discharge path 39 there are situated a first switch 41 and a second switch 42. In dependence on the selected switch 41, 42, the paper roll transport carriages 5 are correspondingly guided into the distribution path 40. The paper roll transport carriages 5 can thus also be guided back again to the feed-discharge path 39 from the distribution path 40 via the respective switch 41, 42.

The distribution path 40 is adjoined at the end side by a first cover web path 43 via a 90° bend. The distribution path 40 is adjoined via a further 90° bend by an intermediate web-cover web path 44 which extends parallel to the first cover web path 43. The distribution path 40 is adjoined via a further 90° bend by an intermediate web-laminating web path 45 which runs parallel to the intermediate web-cover web path 44. The distribution path 40 is adjoined at the end side via a further 90° bend by an alternative path 46. The intermediate web-cover web path 44 is arranged between the first cover web path 43 and the intermediate web-laminating web path 45. The intermediate web-laminating web path 45 is arranged between the intermediate web-cover web path 44 and the alternative path 46.

The first cover web path 43 and the intermediate web-cover web path 44 can be reached from the feed-discharge path 39 via the first switch 41. The intermediate web-laminating web path 45 and the alternative path 46 can be reached from the feed-discharge path 39 via the second switch 42. The alternative path 46 serves to improve the movement paths of the paper roll transport carriages 5.

The first cover web path 43 is adjoined by a cover web return path 47 which runs straight and is aligned with the first cover web path 43. The first cover web path 43 is adjoined via a switch and a bend by a first cover web feed path 48 and via a further switch and a further bend by a second cover web path feed path 49.

The cover web return path 47, the first cover web feed path 48 and the second cover web feed path 49 each run mainly straight, parallel to one another and each extend perpendicularly to the corrugated board production line. They are each one-way paths and pass through the corrugated board production line. The cover web feed paths 48, 49 are aligned with the unrolling units of the first cover web splicing device 29.

The cover web return path 47, the first cover web feed path 48 and the second cover web feed path 49 are situated in a first laser scanner protective region 50. By means of a light curtain and an operator-carried transponder, movements which entail risk are stopped by the central control device 65 in the case of the laser scanner protective region 50 being entered, and are also enabled again, without it being necessary for an operator to enable the corresponding locations again.

The intermediate web-cover web path 44 is adjoined by an intermediate web-cover web return path 51 which runs straight and is aligned with the intermediate web-cover web path 44. The intermediate web-cover web path 44 is adjoined via a switch and a bend by a first intermediate web feed path 52. Furthermore, the intermediate web-cover web path 44 is adjoined via a further switch and a further bend by a second intermediate web feed path 53. Furthermore, the intermediate web-cover web path 44 is adjoined via a further switch and a further bend by a third cover web feed path 54. Furthermore, the intermediate web-cover web path 44 is adjoined via a further switch and a further bend by a fourth cover web feed path 55.

The first intermediate web feed path 52, the second intermediate web feed path 53, the third cover web feed path 54 and the fourth cover web feed path 55 and also the intermediate web-cover web return path 51 each run mainly straight, parallel to one another and perpendicular to the corrugated board production line. They are each one-way paths. The first intermediate web feed path 52 and the second intermediate web feed path 53 are aligned with the unrolling units of the first intermediate web splicing device 30. The third cover web feed path 54 and the fourth cover web feed path 55 are aligned with the unrolling units of the second cover web splicing device 32.

The first intermediate web feed path 52, the second intermediate web feed path 53, the third cover web feed path 54 and the fourth cover web feed path 55 and also the intermediate web-cover web return path 51 pass through the corrugated board production line and are situated in a second laser scanner protective region 56. By means of a light curtain and an operator-carried transponder, movements which entail risk are stopped in the case of the second laser scanner protective region 56 being entered, and are also enabled again, without it being necessary for an operator to enable the corresponding locations again.

The intermediate web-laminating web path 45 is adjoined by an intermediate web-laminating web return path 57 which runs straight and is aligned with the intermediate web-laminating web path 45. The intermediate web-laminating web path 45 is adjoined via a switch and a bend by a third intermediate web feed path 58. The intermediate web-laminating web path 45 is adjoined via a switch and a bend by a fourth intermediate web feed path 59. The intermediate web-laminating web path 45 is adjoined via a switch and a bend by a first laminating web feed path 60. The intermediate web-laminating web path 45 is adjoined via a switch and a bend by a second laminating web feed path 61.

The third intermediate web feed path 58, the fourth intermediate web feed path 59, the first laminating web feed path 60 and the second laminating web feed path 61 and also the intermediate web-laminating web return path 57 each run mainly straight, parallel to one another and perpendicular to the corrugated board production line. The third intermediate web feed path 58 and the fourth intermediate web feed path 59 are aligned with the unrolling units of the second intermediate web splicing device 33. The first laminating web feed path 60 and the second laminating web feed path 61 are aligned with the unrolling units of the laminating web splicing device 34.

The third intermediate web feed path 58, the fourth intermediate web feed path 59, the first laminating web feed path 60 and the second laminating web feed path 61 and also the intermediate web-laminating web return path 57 pass through the corrugated board production line and are situated in a third laser scanner protective region 62. By means of a light curtain and an operator-carried transponder, movements which entail risk are stopped in the case of the third laser scanner protective region 62 being entered, and are also enabled again, without it being necessary for an operator to enable the corresponding locations again.

The transport of the paper rolls 27 via the paper roll transport carriages 5 in the corrugated board system will be explained in further detail below. A central control device 65 of the corrugated board system causes a paper roll 27 which is to be used to be retrieved from the paper roll store 36 for the corrugated board production in the corrugated board production line via a paper roll transport carriage 5. For this purpose, a paper roll transport carriage 5 travels to the transfer point 36*a* if it is not yet situated there. The paper roll 27 is loaded there onto the paper roll transport carriage 5. It is situated in a centered manner in the paper roll receptacle 2.

The central control device 65 then sends the loaded paper roll transport carriage 5 to the splicing device 29, 30, 32, 33 or 34 requiring the paper roll 27.

The paper roll transport carriages 5 can move in a laterally offset manner with respect to the movement path marking 38, in particular by targeted actuation. The paper rolls 27 can thus be oriented, in accordance with their outside diameter, exactly according to the splicing device 29, 30, 32, 33 or 34 to be loaded or according to the transfer point 36*a*. Alternatively, the paper roll transport carriage 5 is designed to displace the paper roll 27 axially with respect to it or with respect to the frame 1.

In order to load a splicing device 29, 30, 32, 33 or 34, the paper roll transport carriage 5 first moves along the feed-discharge path 39 in the direction of the distribution path 40.

If the first cover web splicing device 29 is to be reloaded with the paper roll 27, the paper roll transport carriage 5 travels via the first switch 41 onto the distribution path 40 and passes the intermediate web-cover web path 44. It then passes via the first cover web path 43 to the first cover web feed path 48 or the second cover web feed path 49. In dependence on the required loading of the first or second unrolling unit of the first cover web splicing device 29, the corresponding feed path 48, 49 is selected.

If this task has been completed, the residual paper roll 27, which may be completely empty or still carry paper, is moved out of the corresponding unrolling unit away from the first cover web path 43. The residual paper roll 27 is then moved via the cover web return path 47, the first cover web path 43, the distribution path 40, the switch 41 and the feed-discharge path 39 back to the paper roll store 36.

If the first intermediate web splicing device 30 is to be reloaded with the paper roll 27, the paper roll transport carriage 5 travels via the first switch 41 and the distribution path 40 into the intermediate web-cover web path 44. In dependence on the required loading of the third or fourth unrolling unit of the first intermediate web splicing device 30, the corresponding feed path 52, 53 is selected.

If this task has been completed, the residual paper roll 27, which may be completely empty or still carry paper, is moved out of the corresponding unrolling unit away from the first intermediate web-cover web path 44. The residual paper roll 27 is then moved via the intermediate web-cover web return path 51, the first intermediate web-cover web path 44, the distribution path 40, the switch 41 and the feed-discharge path 39 back to the paper roll store 36.

If the second cover web splicing device 32 is to be reloaded with the paper roll 27, the paper roll transport carriage 5 travels via the first switch 41 and the distribution path 40 into the intermediate web-cover web path 44. In dependence on the required loading of the fifth or sixth unrolling unit of the second cover web splicing device 29, the corresponding feed path 54, 55 is selected.

If this task has been completed, the residual paper roll 27, which may be completely empty or still carry paper, is moved out of the corresponding unrolling unit away from the intermediate web-cover web path 44. The residual paper roll 27 is then moved via the intermediate web-cover web return path 51, the intermediate web-cover web path 44, the distribution path 40, the switch 41 and the feed-discharge path 39 back to the paper roll store 36.

If the second intermediate web splicing device 33 is to be reloaded with the paper roll 27, the paper roll transport carriage 5 travels via the second switch 42 and the distribution path 40 into the intermediate web-laminating web path 45. In dependence on the required loading of the seventh or eighth unrolling unit of the second intermediate web splicing device 33, the corresponding feed path 58, 59 is selected.

If this task has been completed, the residual paper roll 27, which may be completely empty or still carry paper, is moved out of the corresponding unrolling unit away from the intermediate web-laminating web path 45. The residual paper roll 27 is then moved via the intermediate web-laminating web return path 57, the intermediate web-laminating web path 45, the distribution path 40, the second switch 42 and the feed-discharge path 39 back to the paper roll store 36.

If the laminating web splicing device 34 is to be reloaded with the paper roll 27, the paper roll transport carriage 5 travels via the second switch 42 and the distribution path 40 into the intermediate web-laminating web path 45. In dependence on the required loading of the ninth or tenth unrolling unit of the laminating web splicing device 34, the corresponding feed path 60, 61 is selected.

If this task has been completed, the residual paper roll 27, which may be completely empty or still carry paper, is moved out of the corresponding unrolling unit away from the intermediate web-laminating web path 45. The residual paper roll 27 is then moved via the intermediate web-laminating web return path 57, the intermediate web-laminating web path 45, the distribution path 40, the second switch 42 and the feed-discharge path 39 back to the paper roll store 36.

The paper roll transport carriages 5 move safely on their movement path, which is formed by the individual paths. In the process, they are charged in charging zones which are formed by coils 66 in the underlying surface along the movement path. The coils 66 are preferably laid centrally with respect to the movement path marking and extend over a large part of the movement path. The electrical energy of the coils 66 is transmitted to the paper roll transport carriages 5 via their energy transmission device 25. The charging zones advantageously coincide with waiting zones.

A circuit is produced in the corrugated board system by way of the paper roll transport carriages 5 and is formed in particular by the inward transport of the paper rolls 27 and the outward transport of the residual paper rolls 27. The inward transport of the paper rolls 27 and/or the outward transport of the residual paper rolls 27 in each case occurs at least partially, preferably at least for the most part, in a one-way street operation or unidirectionally. The outward transport or return transport of the residual paper rolls 27 occurs at least partially, preferably at least for the most part, on a separate path. A circuit of paper rolls 27 and residual paper rolls 27 with one-way street operation is thus made possible.

The feed-discharge path 39 is used both for feeding and for discharging the paper roll transport carriages 5 with respect to the paper roll store 36, regardless of the splicing device 29, 32, 30, 33, 34 for which the paper roll transport carriages 5 are provided or from which they come.

The distribution path 40 is also at least partially used by all the paper roll transport carriages 5. The paper roll transport carriages 5 use it at least partially in order to come to the planned splicing device 29, 32, 30, 33, 34 and/or to return from it or to the feed-discharge path 39.

In the corrugated board system, in particular, a plurality of, preferably all, the paper rolls 27 to be displaced for a task can be displaced in parallel or simultaneously by the paper roll transport carriages 5, which is very economical and leads to quick paper roll changes. The movement path of the paper roll transport carriages 5 is directional.

It is advantageous if, according to an alternative embodiment, the paper roll transport carriages 5 are set in movement only if a switch on the paper roll transport carriage 5 is supplied with energy by way of induction. Without energy from the coils 66, the paper roll transport carriage 5 brakes in a controlled manner to a standstill.

The safety device 22 of the paper roll transport carriages 5 prevents collisions.

It is expedient if the respective position of the paper roll transport carriage 5 can be determined, for example by means of sensors. Exact positions of the respective paper roll transport carriage 5 can advantageously be determined by encoding means along the movement path.

Each paper roll transport carriage 5 is also manually controllable. For this purpose, each paper roll transport carriage 5 has an auxiliary control device 63 for connection to an external portable auxiliary controller 64.

Alternatively, a corrugated board production line is provided for forming a three-layer or seven-layer corrugated board web.

A second embodiment of a corrugated board system will be described below with reference to FIG. 16. Identical parts or elements are given the same reference signs as in the first embodiment, with reference being explicitly made hereby to the description thereof. Structurally different but functionally identical parts are given the same reference signs followed by an "a".

Figure 16:
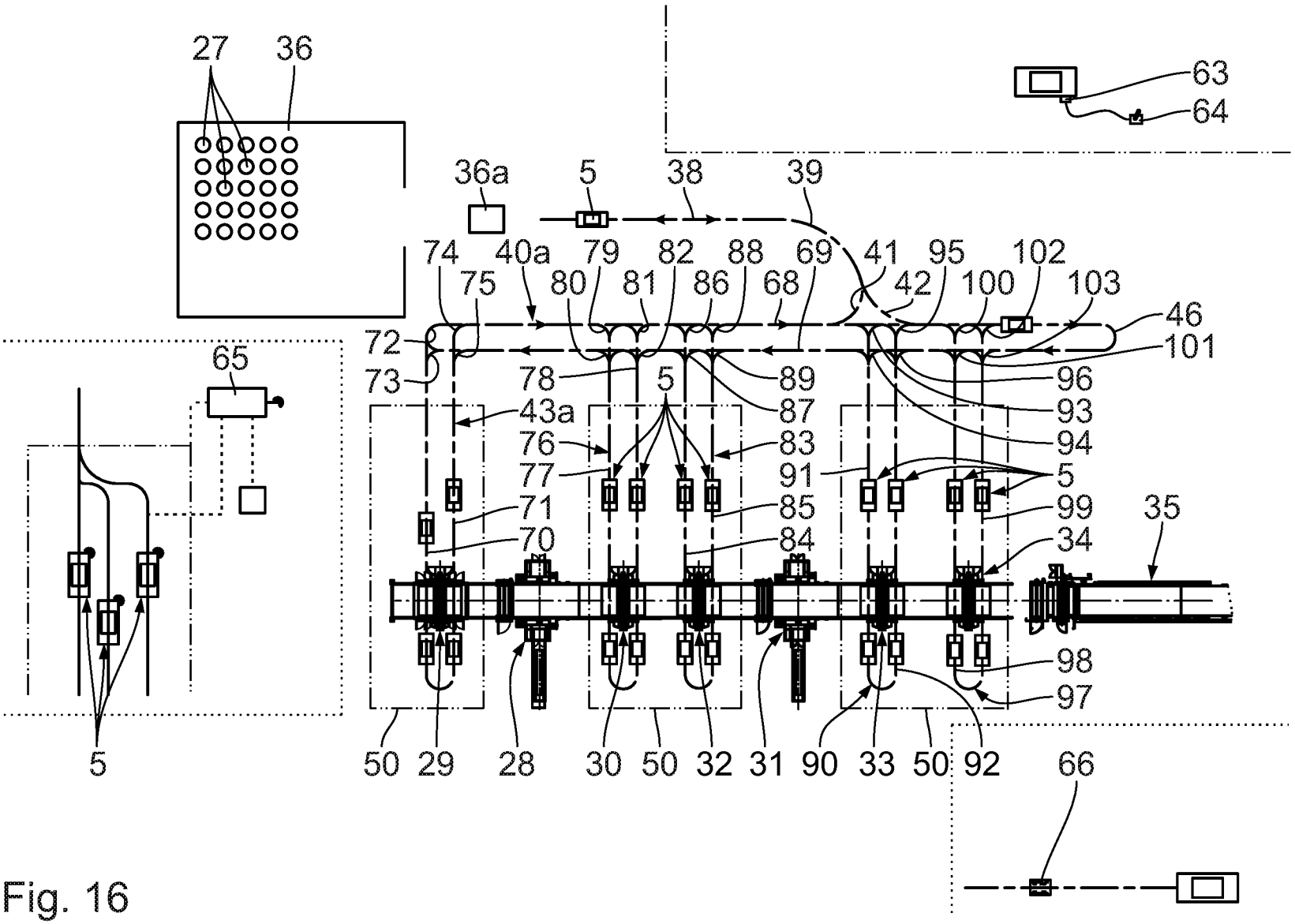
FIG. 16 shows a partial plan view of a simplified corrugated board system according to the invention according to a second embodiment in which transport carriages and their movement paths are also illustrated.

By comparison with the first embodiment, in the case of the corrugated board system according to FIG. 16 the distribution path **40*a* is configured as a one-way street and as a circuit. The distribution path 40*a*, which is thus endless, comprises a substantially straight first distribution path section 68, which adjoins the first switch 41 and second switch 42, and a second distribution path section 69 which runs parallel to the first distribution path section 68. The first and second distribution path section 68, 69 extend parallel to the straight section of the feed-discharge path 39** and to the corrugated board production line and are connected to one another.

On the first distribution path section 68, the paper roll transport carriages 5 are moved where appropriate in a first direction during the operation of the corrugated board system, whereas the paper roll transport carriages 5 on the second distribution path section 69 are moved in a second direction opposite to the first direction.

The distribution path **40*a* is adjoined by a first cover web path 43*a*. The first distribution path section 68 and second distribution path section 69 are adjoined by the first cover web path 43*a*, which is quasi endless and comprises a first cover web path section 70 and a second cover web path section 71. The cover web path sections 70, 71 extend parallel to one another and are aligned with the unrolling units of the first cover web splicing device 29. The first cover web path section 70 adjoins the first distribution path section 68 via a connection piece 72 and adjoins the second distribution path section 69 via a bend 73. The second cover web path section 71 adjoins the first distribution path section 68 via a bend 74 and adjoins the second distribution path section 69 via a bend 75. The first and second cover web path sections 70, 71** pass through the corrugated board production line at the respective unrolling unit and are connected to one another on the other side of the corrugated board production line.

The paper roll transport carriages 5 can be moved both on the first cover web path section 70 and on the second cover web path section 71 in opposite directions for loading the first cover web splicing device 29 and removing residual paper rolls 27. A circulating transport of the paper roll transport carriages 5 in one direction for loading the first cover web splicing device 29 and removing a residual paper roll 27 along the first cover web path 43*a* is also possible.

The distribution path 40*a* is adjoined by a first intermediate web path 76. The first distribution path section 68 and second distribution path section 69 are adjoined by the first intermediate web path 76, which is quasi endless and comprises a first intermediate web path section 77 and a second intermediate web path section 78. The intermediate web path sections 77, 78 extend parallel to one another and to the cover web path sections 70, 71. They are aligned with the unrolling units of the first intermediate web splicing device 30. The first intermediate web path section 77 is connected to the first distribution path section 68 via a double bend 79 and to the second distribution path section 69 via a double bend 80. The second intermediate web path section 78 is connected to the first distribution path section 68 via a double bend 81 and to the second distribution path section 69 via a second double bend 82. The first and second intermediate web path sections 77, 78 pass through the corrugated board production line at the respective unrolling unit and are connected to one another on the other side of the corrugated board production line.

The paper roll transport carriages 5 can be moved both on the first intermediate web path section 77 and on the second intermediate web path section 78 in opposite directions for loading the first intermediate web splicing device 30 and removing residual paper rolls 27. A circulating transport of the paper roll transport carriages 5 in one direction for loading the first intermediate web splicing device 30 and removing a residual paper roll 27 along the first intermediate web path 76 is also possible.

The distribution path 40*a* is adjoined by a second cover web path 83. The first distribution path section 68 and the second distribution path section 69 are adjoined by the second cover web path 83, which is quasi endless and comprises a first cover web path section 84 and a second cover web path section 85. The cover web path sections 84, 85 extend parallel to one another and to the cover web path sections 70, 71. They are aligned with the unrolling units of the second cover web splicing device 32. The first cover web path section 84 adjoins the first distribution path section 68 via a double bend 86 and adjoins the second distribution path section 69 via a double bend 87. The second cover web path section 85 adjoins the first distribution path section 68 via a double bend 88 and adjoins the second distribution path section 69 via a double bend 89. The first and second cover web path sections 84, 85 pass through the corrugated board production line at the respective unrolling unit and are connected to one another on the other side of the corrugated board production line.

The paper roll transport carriages 5 can be moved both on the first cover web path section 84 and on the second cover web path section 85 in opposite directions for loading the second cover web splicing device 32 and removing residual paper rolls 27. A circulating transport of the paper roll transport carriages 5 in one direction for loading the second cover web splicing device 32 and removing a residual paper roll 27 along the second cover web path 83 is also possible.

The distribution path 40*a* is adjoined by a second intermediate web path 90. The first distribution path section 68 and second distribution path section 69 are adjoined by the second intermediate web path 90, which is quasi endless and comprises a first intermediate web path section 91 and a second intermediate web path section 92. The intermediate web path sections 91, 92 extend parallel to one another and to the cover web path sections 70, 71. They are aligned with the unrolling units of the second intermediate web splicing device 33. The first intermediate web path section 91 adjoins the first distribution path section 68 via a double bend 93 and adjoins the second distribution path section 69 via a double bend 94. The second intermediate web path section 92 adjoins the first distribution path section 68 via a double bend 95 and adjoins the second distribution path section 69 via a double bend 96. The first and second intermediate web path sections 91, 92 pass through the corrugated board production line at the respective unrolling unit and are connected to one another on the other side of the corrugated board production line.

The paper roll transport carriages 5 can be moved both on the first intermediate web path section 91 and on the second intermediate web path section 92 in opposite directions for loading the second intermediate web splicing device 33 and removing residual paper rolls 27. A circulating transport of the paper roll transport carriages 5 in one direction for loading the second intermediate web splicing device 33 and removing a residual paper roll 27 along the second intermediate web path 90 is also possible.

The distribution path 40*a* is adjoined by a laminating web path 97. The first distribution path section 68 and second distribution path section 69 are adjoined by the laminating web path 97, which is quasi endless and comprises a first laminating web path section 98 and a second laminating web path section 99. The laminating web path sections 98, 99 extend parallel to one another and to the cover web path sections 70, 71. They are aligned with the unrolling units of the laminating web splicing device 34. The first laminating web path section 98 adjoins the first distribution path section 68 via a double bend 100 and adjoins the second distribution path section 69 via a double bend 101. The second laminating web path section 99 adjoins the first distribution path section 68 via a double bend 102 and adjoins the second distribution path section 69 via a double bend 103. The first and second laminating web path sections 98, 99 pass through the corrugated board production line at the respective unrolling unit and are connected to one another on the other side of the corrugated board production line.

The paper roll transport carriages 5 can be moved both on the first laminating web path section 98 and on the second laminating web path section 99 in opposite directions for loading the laminating web splicing device 34 and removing residual paper rolls 27. A circulating transport of the paper roll transport carriages 5 in one direction for loading the laminating web splicing device 34 and removing a residual paper roll 27 along the laminating web path 97 is also possible.

The cover web paths 43*a*, 83, intermediate web paths 76, 90 and the laminating web path 97 are connected to the distribution path 40*a* at a distance from one another and run at a distance from one another. They are situated in a laser scanner protective region 50.

The transport of the paper rolls 27 via the paper roll transport carriages 5 in the corrugated board system will be explained in more detail below. By comparison with the preceding embodiment, during operation each paper roll transport carriage 5 always moves from the feed-discharge path 39 via the second switch 42 onto the distribution path 40*a*. Each paper roll transport carriage 5 travels via the first distribution path section 68 onto the second distribution path section 69. The central control device 65 sends the loaded paper roll transport carriage 5 to the splicing device 29, 30, 32, 33, 34 requiring the paper roll 27 via the corresponding path 70, 71, 77, 78, 84, 85, 91, 92, 98 or 99.

If the first cover web splicing device 29 is to be reloaded with the paper roll 27, the paper roll transport carriage 5 travels via the bend 73 or the bend 75 from the second distribution path section 69 onto the cover web path section 70 or 71. In dependence on the required loading of the first or second unrolling unit of the first cover web splicing device 29, the corresponding cover web path section 70, 71 is selected.

The paper roll transport carriage 5 with a residual paper roll 27 can be returned via the bend 72 or the bend 74 from the respective cover web section 70, 71 to the first distribution path section 68 and can be moved from there via the first switch 41 and the feed-discharge path 39 back to the paper roll store 36. Here, the paper roll transport carriage 5 moves in an opposite direction by comparison with the loading.

If the first intermediate web splicing device 30 is to be reloaded with the paper roll 27, the paper roll transport carriage 5 moves via the double bend 80 or the double bend 82 from the second distribution path section 69 onto the intermediate web path section 77 or 78. In dependence on the required loading of the first or second unrolling unit of the first intermediate web splicing device 30, the corresponding intermediate web path section 77, 78 is selected. The paper roll transport carriage 5 can also pass via the double bend 79 or the double bend 81 from the first distribution path section 68 onto the intermediate web path section 77 or 78.

The paper roll transport carriage 5 with a residual paper roll 27 can be returned via the double bend 79 or the double bend 81 from the respective intermediate web path section 77, 78 to the first distribution path section 68. The paper roll transport carriage 5 with a residual paper roll 27 can be returned via the double bend 80 or the double bend 82 to the second distribution path section 69. Here, the paper roll transport carriage 5 moves in an opposite direction by comparison with the loading. It can be moved via the first switch 41 and the feed-discharge path 39 back to the paper roll store 36.

If the second cover web splicing device 32 is to be reloaded with the paper roll 27, the paper roll transport carriage 5 moves via the double bend 87 or the double bend 89 from the second distribution path section 69 onto the cover web path section 84 or 85. In dependence on the required loading of the first or second unrolling unit of the second cover web splicing device 32, the corresponding cover web path section 84, 85 is selected. The paper roll transport carriage 5 can also pass via the double bend 86 or the double bend 88 from the first distribution path section 68 onto the cover web path section 84 or 85.

The paper roll transport carriage 5 with a residual paper roll 27 can be returned via the double bend 86 or the double bend 88 from the respective cover web path section 84, 85 to the first distribution path section 68. The paper roll transport carriage 5 with a residual paper roll 27 can be returned via the double bend 87 or the double bend 89 to the second distribution path section 69. Here, the paper roll transport carriage 5 moves in an opposite direction by comparison with the loading. It can be moved via the first switch 41 and the feed-discharge path 39 back to the paper roll store 36.

If the second intermediate web splicing device 33 is to be reloaded with the paper roll 27, the paper roll transport carriage 5 moves via the double bend 94 or the double bend 96 from the second distribution path section 69 onto the intermediate web path section 91 or 92. In dependence on the required loading of the first or second unrolling unit of the second intermediate web splicing device 33, the corresponding intermediate web path section 91, 92 is selected. The paper roll transport carriage 5 can also pass via the double bend 93 or the double bend 95 from the first distribution path section 68 onto the intermediate web path section 91 or 92.

The paper roll transport carriage 5 with a residual paper roll 27 can be returned via the double bend 93 or the double bend 95 from the respective intermediate web path section 91, 92 to the first distribution path section 68. The paper roll transport carriage 5 with a residual paper roll 27 can be returned via the double bend 94 or the double bend 96 to the second distribution path section 69. Here, the paper roll transport carriage 5 moves in an opposite direction by comparison with the loading. It can be moved via the first switch 41 and the feed-discharge path 39 back to the paper roll store 36.

If the laminating web splicing device 34 is to be reloaded with the paper roll 27, the paper roll transport carriage 5 travels via the double bend 101 or the double bend 103 from the second distribution path section 69 onto the laminating web path section 98 or 99. In dependence on the required loading of the first or second unrolling unit of the laminating web splicing device 34, the corresponding laminating web path section 98, 99 is selected. The paper roll transport carriage 5 can also pass via the double bend 100 or the double bend 102 from the first distribution path section 68 onto the laminating web path section 77 or 78.

The paper roll transport carriage 5 with a residual paper roll 27 can be returned via the double bend 100 or the double bend 101 from the respective laminating web path section 98, 99 to the first distribution path section 68. The paper roll transport carriage 5 with a residual paper roll 27 can be returned via the double bend 101 or the double bend 103 to the second distribution path section 69. Here, the paper roll transport carriage 5 moves in an opposite direction by comparison with the loading. It can be moved via the first switch 41 and the feed-discharge path 39 back to the paper roll store 36.

The invention claimed is:

1. A corrugated board system, comprising:

at least one intermediate web dispensing device for dispensing at least one intermediate web;

at least one cover web dispensing device for dispensing at least one cover web;

at least one corrugated board production device for producing at least one corrugated board web laminated on one side from the at least one cover web and intermediate web, wherein the at least one corrugated board production device is arranged downstream of the at least one intermediate web dispensing device and cover web dispensing device;

a laminating web dispensing device for dispensing a laminating web;

a connecting device for connecting the at least one corrugated board web laminated on one side and the laminating web to one another upon formation of a corrugated board web laminated on both sides;

at least one transport carriage for transporting at least one material roll along at least one movement path between at least one material roll store and the at least one intermediate web dispensing device, cover web dispensing device and/or laminating web dispensing device;

a control device for actuating the at least one transport carriage; and at least one movement path specification arrangement for specifying the at least one movement path for the at least one transport carriage, wherein the at least one transport carriage is movable at least in regions so as to be laterally offset with respect to the at least one movement path specification arrangement.

2. The corrugated board system as claimed in claim 1, further comprising at least one feed-discharge path which runs between the at least one material roll store and the at least one intermediate web dispensing device, cover web dispensing device and/or laminating web dispensing device and which is designed at least in regions as a two-way traffic path for moving the at least one transport carriage in opposite directions.

3. The corrugated board system as claimed in claim 1, further comprising at least one distribution path for guiding the at least one transport carriage to the intended dispensing device and advantageously for returning the at least one transport carriage, wherein the at least one distribution path is arranged between the at least one material roll store and the at least one intermediate web dispensing device, cover web dispensing device and/or laminating web dispensing device.

4. The corrugated board system as claimed in claim 1, further comprising at least one position marking for determining the position of the at least one transport carriage when the at least one position marking and the at least one transport carriage are arranged adjacent to each other.

5. The corrugated board system as claimed in claim 1, further comprising at least one transport carriage buffer region for avoiding waiting times for transporting in or transporting away new material rolls, the at least one transport carriage buffer region being arranged upstream of the at least one intermediate web dispensing device, cover web dispensing device and/or laminating web dispensing device.

6. The corrugated board system as claimed in claim 1, further comprising a safety arrangement for safeguarding the at least one movement path at least in regions.

7. The corrugated board system as claimed in claim 1, further comprising at least one electrical charging point along the at least one movement path for supplying the at least one transport carriage with electrical energy on the at least one movement path.

8. The corrugated board system as claimed in claim 1, wherein the control device controls a central access control.

9. The corrugated board system as claimed in claim 1, wherein the at least one transport carriage is self-propelled.

10. The corrugated board system as claimed in claim 1, wherein the at least one movement path is defined in a software.

11. The corrugated board system as claimed in claim 1, wherein the movement path for the at least one transport carriage is arbitrarily predefinable.

12. The corrugated board system as claimed in claim 1, wherein a movement path specification arrangement is configured as a marking.

13. The corrugated board system as claimed in claim 1, wherein the control device specifies how the transport carriage is intended to move at switches or crossings.

14. The corrugated board system as claimed in claim 1, wherein the at least one transport carriage has its own communication device with a receiving unit for receiving external information items or signals.

15. The corrugated board system as claimed in claim 1, wherein the at least one transport carriage has at least its own movement drive for driving at least one drivable running unit thereof.

16. The corrugated board system as claimed in claim 1, wherein the transport carriage comprises an energy storage unit.

17. The corrugated board system as claimed in claim 1, wherein the at least one transport carriage travels in a rail-free manner.

18. The corrugated board system as claimed in claim 1, wherein the at least one transport carriage is steerable.

19. The corrugated board system as claimed in claim 1, further comprising at least one transfer device for transferring at least one material roll to the at least one intermediate web dispensing device, cover web dispensing device and/or laminating web dispensing device, wherein the corrugated board system advantageously comprises at least one material roll position detection arrangement assigned to the at least one transfer device.

20. The corrugated board system as claimed in claim 1, further comprising at least one movement path specification arrangement positioned on a building.

21. The corrugated board system as claimed in claim 1, wherein the at least one movement path specification arrangement has at least one at least one of straight and curved section.

22. The corrugated board system as claimed in claim 1, further comprising at least one position marking positioned on a building.

23. The corrugated board system as claimed in claim 1, further comprising at least one electrical charging point along the at least one movement path, the electrical charging point being positioned on a building.

24. The corrugated board system as claimed in claim 1, wherein a movement path specification arrangement is configured as a marking which comprises switches and crossings.

25. The corrugated board system as claimed in claim 1, wherein the at least one transport carriage is steerable by way of corresponding actuation.

26. A method for producing corrugated board, the method comprising the steps of:

dispensing at least one intermediate web by means of at least one intermediate web dispensing device;

dispensing at least one cover web by means of at least one cover web dispensing device;

producing at least one corrugated board web laminated on one side from the at least one cover web and intermediate web by means of at least one corrugated board production device arranged downstream of the at least one intermediate web dispensing device and cover web covering device;

dispensing a laminating web by means of a laminating web dispensing device;

connecting the at least one corrugated board web laminated on one side to the laminating web upon formation of a corrugated board web laminated on both sides by means of a connecting device;

transporting at least one material roll along at least one movement path between at least one material roll store and the at least one intermediate web dispensing device, cover web dispensing device and/or laminating web dispensing device by means of at least one transport carriage, wherein at least one movement path specification arrangement is configured for specifying the at least one movement path for the at least one transport carriage, wherein the at least one transport carriage is movable at least in regions so as to be laterally offset with respect to the at least one movement path specification arrangement; and actuating the at least one transport carriage by means of a control device.

27. A corrugated board system, comprising:

at least one intermediate web dispensing device for dispensing at least one intermediate web;

at least one cover web dispensing device for dispensing at least one cover web;

at least one corrugated board production device for producing at least one corrugated board web laminated on one side from the at least one cover web and intermediate web, wherein the at least one corrugated board production device is arranged downstream of the at least one intermediate web dispensing device and cover web dispensing device;

a laminating web dispensing device for dispensing a laminating web;

a connecting device for connecting the at least one corrugated board web laminated on one side and the laminating web to one another upon formation of a corrugated board web laminated on both sides;

at least one transport carriage for transporting at least one material roll along at least one movement path between at least one material roll store and the at least one intermediate web dispensing device, cover web dispensing device and/or laminating web dispensing device, wherein the at least one transport carriage is movable along an imaginary transport path; and a control device for actuating the at least one transport carriage.

28. A method for producing corrugated board, comprising the steps of:

dispensing at least one intermediate web by means of at least one intermediate web dispensing device;

dispensing at least one cover web by means of at least one cover web dispensing device;

producing at least one corrugated board web laminated on one side from the at least one cover web and intermediate web by means of at least one corrugated board production device arranged downstream of the at least one intermediate web dispensing device and cover web covering device;

dispensing a laminating web by means of a laminating web dispensing device;

connecting the at least one corrugated board web laminated on one side to the laminating web upon formation of a corrugated board web laminated on both sides by means of a connecting device;

transporting at least one material roll along at least one movement path between at least one material roll store and the at least one intermediate web dispensing device, cover web dispensing device and/or laminating web dispensing device by means of at least one transport carriage, wherein the at least one transport carriage is movable along an imaginary transport path; and actuating the at least one transport carriage by means of a control device.

* * * * *